US007244893B2

(12) United States Patent
Clark

(10) Patent No.: US 7,244,893 B2
(45) Date of Patent: Jul. 17, 2007

(54) CABLE INCLUDING NON-FLAMMABLE MICRO-PARTICLES

(75) Inventor: William T. Clark, Lancaster, MA (US)

(73) Assignee: Belden Technologies, Inc., St. Louis, MO (US)

( * ) Notice: Subject to any disclaimer, the term of this patent is extended or adjusted under 35 U.S.C. 154(b) by 0 days.

(21) Appl. No.: 10/862,767

(22) Filed: Jun. 7, 2004

(65) Prior Publication Data

US 2005/0023028 A1 Feb. 3, 2005

Related U.S. Application Data

(60) Provisional application No. 60/477,519, filed on Jun. 11, 2003.

(51) Int. Cl.
*H01B 11/02* (2006.01)

(52) U.S. Cl. ..... 174/113 R

(58) Field of Classification Search ..... 174/102 SC, 174/110 R, 113 R, 113 C, 110 A, 112, 110 F
See application file for complete search history.

(56) References Cited

U.S. PATENT DOCUMENTS

| | | | |
|---|---|---|---|
| 483,285 | A | 9/1892 | Guilleaume |
| 867,659 | A | 10/1907 | Hoopes et al. |
| 1,008,370 | A | 11/1911 | Robillot |
| 1,132,452 | A | 3/1915 | Davis |
| 1,700,606 | A | 1/1929 | Beaver |
| 1,883,269 | A | 10/1932 | Yonkers |
| 1,940,917 | A | 12/1933 | Okazaki |
| 1,976,847 | A | 10/1934 | Gordon et al. |
| 1,977,209 | A | 10/1934 | Sargent |
| 1,995,201 | A | 3/1935 | Delon |
| 2,218,830 | A | 10/1940 | Rose et al. |
| 2,501,457 | A | 3/1950 | Thelin |
| 2,538,019 | A | 1/1951 | Lee |
| 2,882,676 | A | 4/1959 | Bryan et al. |
| 3,055,967 | A | 9/1962 | Bondon |
| 3,176,065 | A | 3/1965 | Alexander et al. |
| 3,328,510 | A | 6/1967 | White |
| 3,340,112 | A | 9/1967 | Davis et al. |
| 3,559,390 | A | 2/1971 | Staschewski |
| 3,603,715 | A | 9/1971 | Edhardt et al. |
| 3,622,683 | A | 11/1971 | Roberts et al. |
| 3,644,659 | A | 2/1972 | Campbell |
| 3,649,744 | A | 3/1972 | Coleman |

(Continued)

FOREIGN PATENT DOCUMENTS

| | | | |
|---|---|---|---|
| JP | 6-52727 | * | 2/1994 |

(Continued)

*Primary Examiner*—Chau N. Nguyen
(74) *Attorney, Agent, or Firm*—Lowrie, Lando & Anastasi, LLP

(57) ABSTRACT

A data communication cable including a plurality of twisted pairs of insulated conductors, each twisted pair including two electrical conductors, each surrounded by an insulating layer and twisted together to form the twisted pair, and a jacket substantially enclosing the plurality of twisted pairs of insulating conductors, wherein the insulating layer includes a dielectric material including a plurality of micro-particles. In one example, the jacket material may also include a plurality of micro-particles. The micro-particles, in one example, are made of a non-burnable and/or non-smokeable material such as, for example, glass or ceramic.

21 Claims, 3 Drawing Sheets

U.S. PATENT DOCUMENTS 3,819,443 A 6/1974 Simons et al.
3,881,052 A 4/1975 Britz et al.
3,911,200 A 10/1975 Simons et al.
4,034,148 A 7/1977 Lang
4,255,303 A * 3/1981 Keogh ..... 523/200
4,283,459 A * 8/1981 Urban et al. ..... 428/379
4,319,940 A 3/1982 Lang
4,487,992 A 12/1984 Tomita
4,500,748 A 2/1985 Klein
4,595,793 A 6/1986 Arroyo et al.
4,605,818 A 8/1986 Arroyo et al.
4,629,285 A * 12/1986 Carter et al. ..... 385/128
4,644,098 A 2/1987 Norris
4,647,714 A 3/1987 Goto
4,654,476 A 3/1987 Barnicol-Ottler et al.
4,697,051 A 9/1987 Beggs et al.
4,710,594 A 12/1987 Walling et al.
4,767,891 A 8/1988 Biegon et al.
4,777,325 A 10/1988 Siwinski
4,778,246 A 10/1988 Carroll
4,784,462 A 11/1988 Priaroggia
4,788,088 A 11/1988 Kohl
4,800,236 A 1/1989 Lemke
4,828,352 A 5/1989 Kraft
4,847,443 A 7/1989 Basconi
4,866,212 A 9/1989 Ingram
4,892,683 A 1/1990 Naseem
4,912,283 A 3/1990 O'Connor
4,970,352 A 11/1990 Satoh
4,987,394 A 1/1991 Harman et al.
5,010,210 A 4/1991 Sidi et al.
5,015,800 A 5/1991 Vaupotic et al.
5,037,999 A 8/1991 Van Deusen
5,043,530 A 8/1991 Davies
5,068,497 A 11/1991 Krieger
5,073,682 A 12/1991 Walling et al.
5,077,449 A 12/1991 Cornibert et al.
5,097,099 A 3/1992 Miller
5,107,076 A 4/1992 Bullock et al.
5,132,488 A 7/1992 Tessier et al.
5,132,490 A 7/1992 Aldissi
5,132,491 A 7/1992 Mulrooney
5,142,100 A 8/1992 Vaupotic
5,146,048 A 9/1992 Yutori et al.
5,149,915 A 9/1992 Brunker et al.
5,155,304 A 10/1992 Gossett et al.
5,170,010 A 12/1992 Aldissi
5,173,961 A 12/1992 Chiasson
5,177,809 A 1/1993 Zeidler
5,180,890 A 1/1993 Pendergrass
5,192,834 A * 3/1993 Yamanishi et al. ... 174/120 SR
5,206,485 A 4/1993 Srubas et al.
5,212,350 A 5/1993 Gebs
5,216,202 A 6/1993 Yoshida et al.
5,220,130 A 6/1993 Walters
5,222,177 A 6/1993 Chu et al.
5,245,134 A 9/1993 Vana, Jr. et al.
5,253,317 A 10/1993 Allen et al.
5,254,188 A 10/1993 Blew
5,298,680 A 3/1994 Kenny
5,304,739 A 4/1994 Klug et al.
5,313,020 A 5/1994 Sackett
5,371,484 A 12/1994 Nixon
5,393,933 A 2/1995 Goertz
5,397,863 A * 3/1995 Afzali-Ardakani et al. . 174/258
5,399,813 A 3/1995 McNeill et al.
5,418,878 A 5/1995 Sass et al.
5,424,491 A 6/1995 Walling et al.
5,493,071 A 2/1996 Newmoyer
5,514,837 A 5/1996 Kenny et al.
5,541,361 A 7/1996 Friesen et al.
5,544,270 A 8/1996 Clark et al.
5,574,250 A 11/1996 Hardie et al.
5,576,515 A 11/1996 Bleich et al.
5,658,406 A 8/1997 Walling et al.
5,666,452 A 9/1997 Deitz, Sr. et al.
5,699,467 A 12/1997 Kojima et al.
5,767,441 A 6/1998 Brorein et al.
5,789,711 A 8/1998 Gaeris et al.
5,821,466 A 10/1998 Clark et al.
5,821,467 A 10/1998 O'Brien et al.
5,834,697 A 11/1998 Baker et al.
5,883,334 A 3/1999 Newmoyer et al.
5,888,100 A 3/1999 Bofill et al.
5,900,588 A 5/1999 Springer et al.
5,920,672 A 7/1999 White
5,936,205 A 8/1999 Newmoyer
5,952,607 A 9/1999 Friesen et al.
5,952,615 A 9/1999 Prudhon
5,956,445 A 9/1999 Deitz, Sr. et al.
5,969,295 A 10/1999 Boucino et al.
5,990,419 A 11/1999 Bogese, II
6,037,546 A 3/2000 Mottine et al.
6,074,503 A 6/2000 Clark et al.
6,091,025 A 7/2000 Cotter et al.
6,150,612 A 11/2000 Grandy et al.
6,153,826 A 11/2000 Kenny et al.
6,162,992 A 12/2000 Clark et al.
6,194,663 B1 2/2001 Friesen et al.
6,248,954 B1 6/2001 Clark et al.
6,255,593 B1 7/2001 Reede
6,272,828 B1 8/2001 Walling et al.
6,273,977 B1 8/2001 Harden et al.
6,288,340 B1 9/2001 Arnould
6,300,573 B1 10/2001 Horie et al.
6,303,867 B1 10/2001 Clark et al.
6,319,604 B1 * 11/2001 Xu ..... 428/379
6,355,876 B1 3/2002 Morimoto
6,441,308 B1 8/2002 Gagnon
6,462,268 B1 10/2002 Hazy et al.
6,531,222 B1 * 3/2003 Tanaka et al. ..... 428/402
6,566,607 B1 5/2003 Walling
6,570,095 B2 5/2003 Clark et al.
6,596,944 B1 7/2003 Clark et al.
2003/0132021 A1 * 7/2003 Gareis ..... 174/113 C
2004/0050584 A1 * 3/2004 Hager et al. ..... 174/155
2004/0247916 A1 * 12/2004 MacDonald et al. ..... 428/523

FOREIGN PATENT DOCUMENTS

JP 6-103824 * 4/1994

* cited by examiner

CABLE INCLUDING NON-FLAMMABLE MICRO-PARTICLES

RELATED APPLICATIONS

This application claims priority under 35 U.S.C. § 119(e) to U.S. Provisional Application Ser. No. 60/477,519, entitled "DATA CABLE INCLUDING MICRO-PARTICLES," filed on Jun. 11, 2003, which is herein incorporated by reference in its entirety.

BACKGROUND OF INVENTION

1. Field of Invention

The present invention is directed to cables employing non-burnable and/or non-smokeable materials, particularly to plenum-rated twisted pair cables using such materials for insulation and jacketing.

2. Discussion of Related Art

Buildings such as office buildings, apartments and other facilities designed for temperature regulation, often include an air space or plenum between the ceiling and floor of successive floors of the building. The plenum is often contiguous throughout the floor and permits warm or cool air to be circulated throughout the building to regulate temperature. Because plenums offer accessibility to the various parts of a building and due to the general convenience of air conduits that typically extend throughout a facility, cabling structures, for instance, the structured cabling of an office local area network (LAN), are often wired through the plenum.

Should a fire occur in, for example, an office building, the walls, insulation and other fire retardant material are often capable of containing the fire within some portion of the building. However, fires that reach the plenum tend to draft and spread to other parts of the building quickly, particularly when the plenum is employed for other purposes and contains flammable material. Unless the communication cables employed in the plenum are flame and/or smoke retardant, a fire that has breached the plenum may ignite the cabling structures which may spread smoke and fire throughout a building. This may quickly intensify and increase the severity of a fire, making it more likely that burn and/or asphyxiation injuries to the occupants of the building will result and increasing the damage that may be done to the building.

Accordingly, various fire codes and in particular the National Electric Code (NEC) prohibits the use of cables in the plenum unless they have been first tested and exhibit satisfactory smoke and fire retardation. The various requirements set forth by the NEC, often referred to generally as the plenum rating, may be satisfied in a series of burn tests provided by, for example, the Underwriters Laboratory (UL).

Plenum rated cables are often made from various fluoropolymer materials. For example, insulating layers formed around the individual wires of a cable are often made from a fluoroethylenepropylene (FEP) material and jackets formed about the cable may be made up of an ethylene tetra fluoroethylene copolymer (ETFE) compound. Other fluoropolymers such as polytetrafluoroethylene (PTFE) may be employed in plenum rated cables as well. Such fluoropolymers are known to generally exhibit smoke and fire retardation characteristics sufficient to pass the burn tests, for example, the "peak smoke" and "average smoke" requirements.

However, fluoropolymer materials are relatively expensive and increase the production costs of manufacturing plenum rated cables. In addition, although fluoropolymers may be generally flame and smoke retardant, under intense flame and/or heat conditions, fluoropolymers may burn and produce smoke.

SUMMARY OF INVENTION

According to one embodiment, a data communication cable comprises a plurality of twisted pairs of insulated conductors, each twisted pair comprising two electrical conductors, each surrounded by an insulating layer and twisted together to form the twisted pair, and a jacket substantially enclosing the plurality of twisted pairs of insulating conductors, wherein the insulating layer includes a dielectric material comprising a plurality of micro-particles. In one example, the micro-particles may be glass or ceramic or another non-burnable and/or non-smokeable material.

In another example, the jacket may comprise a dielectric material including a second plurality of micro-particles, that may be mixed with the jacket material or embedded therein. The second plurality of micro-particles may be, for example, made of a non-burnable and/or non-smokeable material such as, but not limited to, glass or ceramic. In yet another example, the second plurality of micro-particles may be filled with a substance having at least one property that changes as function of thermal conditions of the cable. According to yet another example, the second plurality of micro-particles may filled with a substance having at least one property that changes as function of a frequency of electromagnetic signals propagating through the cable.

According to another embodiment, the cable may further comprise a separator disposed among the plurality of twisted pairs of insulated conductors. The separator may also comprise a material having a third plurality of micro-particles, which may be embedded therein or may be mixed with the separator material.

According to another embodiment, an insulated conductor comprises a conductor, an insulating layer surrounding the conductor so as to form the insulated conductor, the insulating layer comprising a dielectric material including a plurality of micro-particles, which may be embedded in the insulating layer or mixed with the material forming the insulating layer, wherein the plurality of micro-particles are made of at least one of a non-burnable material and a non-smokeable material. One or more twisted pairs may be made using such insulated conductors. These twisted pairs may, in turn, be used in a data communication cable.

BRIEF DESCRIPTION OF DRAWINGS

The accompanying drawings, are not intended to be drawn to scale. In the drawings, each identical or nearly identical component that is illustrated in various figures is represented by a like numeral. For purposes of clarity, not every component may be labeled in every drawing. In the drawings.

DETAILED DESCRIPTION

Figure 1A:
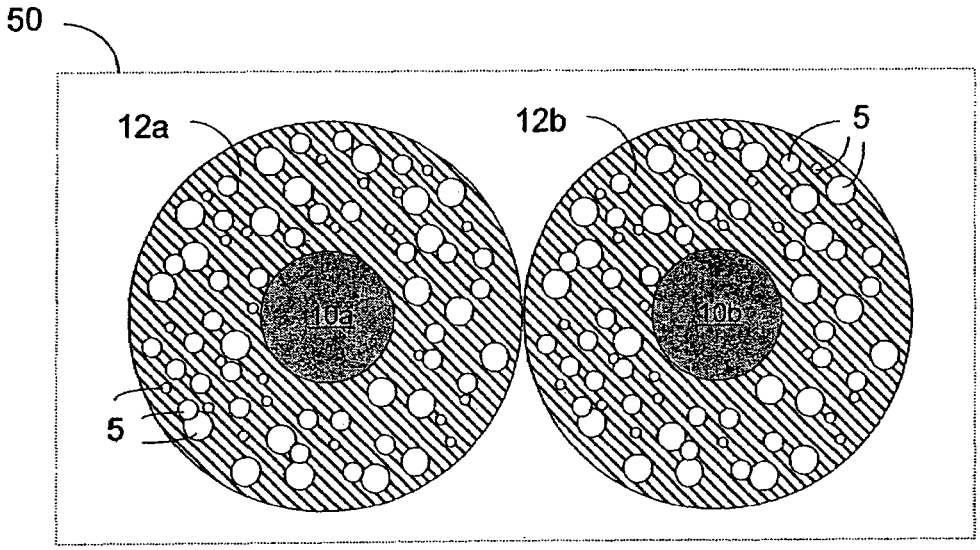
FIG. 1A is a first cross-sectional view of one embodiment of a cable according to aspects of the invention.

Various embodiments and aspects thereof will now be discussed in detail with reference to the accompanying figures. It is to be appreciated that this invention is not limited in its application to the details of construction and the arrangement of components set forth in the following description or illustrated in the drawings. The invention is capable of other embodiments and of being practiced or of being carried out in various ways. Examples of specific implementations are provided herein for illustrative purposes only. In particular, acts, elements and features discussed in connection with one embodiment are not intended to be excluded from a similar role in other embodiments. For example, the various compositions, arrangements and configurations of micro-particles described in any embodiment should be considered as contemplated for each of the embodiments described herein. Also, the phraseology and terminology used herein is for the purpose of description and should not be regarded as limiting. The use of "including," "comprising," or "having," "containing", "involving", and variations thereof herein, is meant to encompass the items listed thereafter and equivalents thereof as well as additional items.

In order to achieve plenum rated cables, manufacturers often employ materials that generally exhibit desirable burn and smoke characteristics such as, for example, any of various fluoropolymer compounds. However, such materials are often relatively expensive. Accordingly, the more of such material that is present in a cable, the higher the cost of manufacturing a plenum rated cable.

Applicants have identified of various methods of reducing or eliminating expensive compounds from data communications cables. For example, according to some embodiments, fluoropolymer material may be replaced in the cable by various less expensive materials that also have desirable flame and/or smoke characteristics, such that the cost of the cable may be reduced. In one example, the fluoropolymers used in conventional plenum cables may be replaced with non-burnable and/or non-smokeable materials. Such non-burnable and/or non-smokeable material may improve the burn characteristics of the cable over those manufactured with fluoropolymer material because the non-burnable and/or non-smokeable materials, respectively add no ignitable mass and do not produce smoke.

It is to be appreciated that for the purposes of this specification, the term "non-burnable" refers generally to materials that do not ignite in the presence of heat and/or flame. For example, materials (e.g., glass or ceramic) that tend to melt rather than burn or have essentially infinite flash points are considered as non-burnable material. The term "non-smokeable" refers generally to material that essentially produces no, or minimal (less than conventional "low-smoke" materials), smoke when exposed to heat, ignited and/or caused to change states.

In one embodiment, non-burnable and/or non-smokeable materials may be used in connection with fluoropolymer materials such that less fluoropolymer material is required to achieve the same or better burn characteristics as a conventional cable using only fluoropolymers. Alternatively, non-burnable and/or non-smokeable materials may be used in place of fluoropolymers to provide a relatively inexpensive plenum rated cable that meets or exceeds the burn characteristics of conventional plenum cables employing fluoropolymers.

Therefore, at least one embodiment of the present invention includes an electrical conductor, which may be, for example, a metal wire, a group of wires stranded together, a composite of metals, a fiber, or any other conductor used in the industry and known in the art. The electrical conductor may be surrounded by an insulating layer that includes a non-burnable and/or non-smokeable material, to form an insulated electrical conductor. According to one example, a plenum-rated data communications cable includes a plurality of insulated electrical conductors wherein the insulating material does not include any fluoropolymer material. In another example, a jacket of the plenum-rated cable may also not include any fluoropolymer materials. In yet another example, the jacket may include a non-burnable and/or non-smokeable material.

Applicant has identified and appreciated that micro-particles may be used to improve various characteristics of data communication cables. Micro-particles are small structures or shapes that may be added to another material to form a composite material, mixture or slurry. In one example, micro-particles used in embodiments of cables may have a diameter in a range of about 1 micrometer (μm) to about 300 μm. However, it is to be appreciated that the micro-particles may have other sizes and may be larger or smaller depending, for example, on the application for which they may be used. Micro-particles may be solid, hollow, partially hollow, porous or filled with other agents and/or materials, and may be of any general shape. Micro-particles may be shaped such that they form an empty micro-volume, cavity or void. Such a micro-volume may be open or closed or contain another agent, substance and/or material. Micro-particles may be mixed with or embedded in various materials and/or used as fillers in various compounds, colloids and/or mixtures.

For example, developments in materials have led to the production of various micro-particles, such as the micro-spheres manufactured by 3M, Emerson Cuming, Inc., and others. These glass micro-spheres, which may be made, for example, from sodium borosilicate, can be manufactured with desired dimensions and may be made hollow, solid, porous or filled. Micro-particles may be formed to different shapes other than spheres, however, spheres have generally desirable manufacturing properties. Micro-particles may be amalgamated into a single material or added to other materials, for example, as a filler in a mixture or slurry. It should be appreciated that micro-particles are not limited to the materials or vendors noted above and other micro-particles may be used in any of the embodiments described below.

Applicant has identified and appreciated that micro-particles may be included in various materials (e.g., thermoplastics) that are used to construct insulating layers, separators, binders, jackets and other components or portions of data communication cables. Applicants have further recognized that the addition of micro-particles formed from non-burnable and/or non-smokeable materials to cables may result in the cable having a variety of generally desirable properties including increased fire and smoke retardation, improved electrical characteristics, improved strength and weight characteristics, lower cost, and other advantages.

Figure 1B:
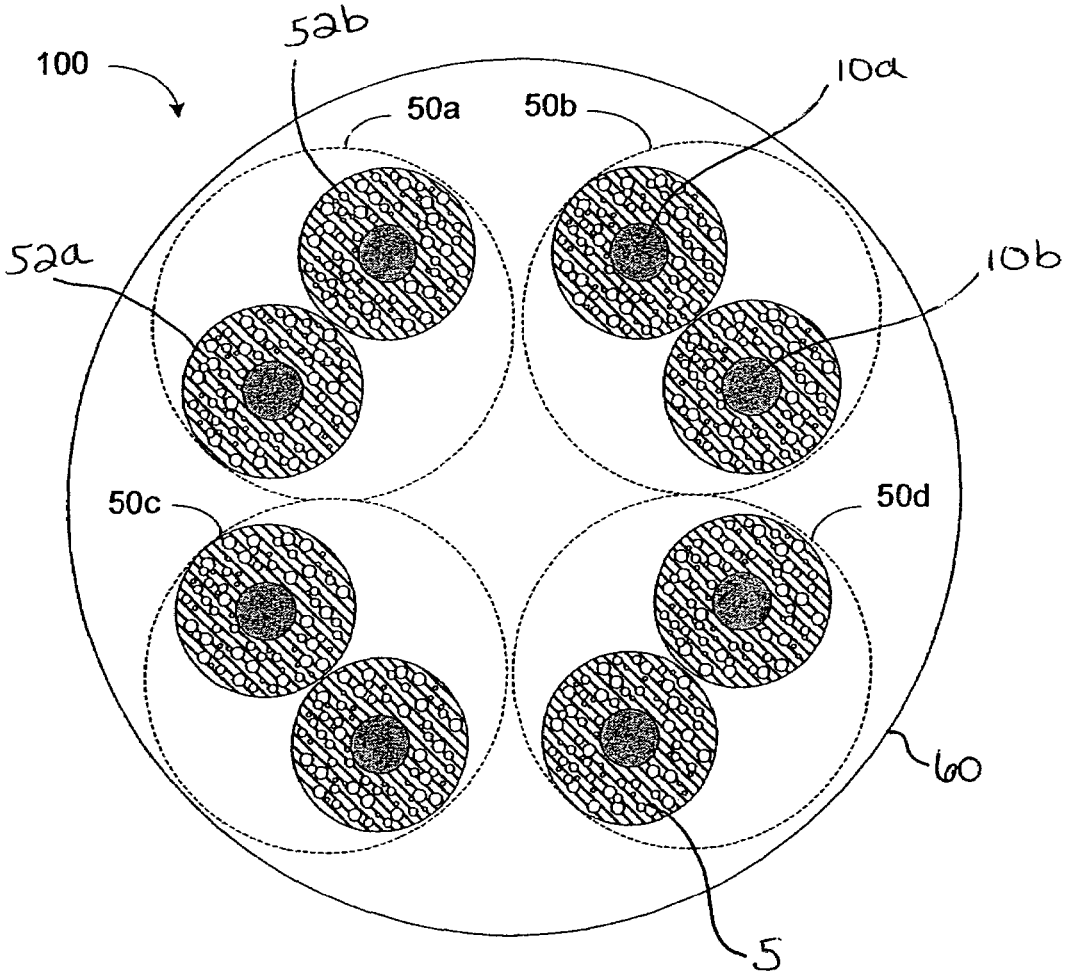
FIG. 1B is a second cross-sectional view of the embodiment of a cable described in FIG. 1A.

Referring to FIG. 1B, there is illustrated a cross-sectional view of one embodiment of a cable according to aspects of the invention. The cable 100 includes four twisted pairs of insulated conductors 50*a*, 50*b*, 50*c*, 50*d* that may be bundled together and jacketed with a jacket 60. Each twisted pair 50 comprises two insulated conductors 52*a*, 52*b*. Each insulated conductor comprises an electrical conductor 10*a*, 10*b* surrounded by an insulating layer 12*a*, 12*b*. It is to be appreciated that although FIG. 1B illustrates a cable including four twisted pairs of conductors, the invention is not so limited and the principles of the invention may be applied to cables having any number of twisted pairs. In addition, the principles of the invention are not limited to twisted pair cables and may be applied, for example, to cables using individual insulated conductors (as opposed to twisted pairs), optical cables, and the like. Also, in twisted pair cables, each twisted pair may be different from other twisted pairs in the cable (e.g., in terms of twist lay length, material used etc.), or some or all of the twisted pairs may be similar or the same.

Referring to FIG. 1A. there is illustrated a twisted pair 50*a* in close-up cross-section. According to one embodiment, the insulating layers 12*a*, 12*b* may be formed of a thermoplastic material having a plurality of micro-particles 5 distributed throughout the material. For example, micro-particles 5 may be glass or ceramic, or another non-burnable and/or non-smokeable material (such as, for example, diamond dust) that may be added as filler to the thermoplastic material before the material is extruded over the conductors to form insulating layers 12*a* and 12*b*, or may be applied andlor provided in any other suitable way. For example, another way of providing a particle-impregnated layer may include providing a bath of ultraviolet-curable resin having micro-particles mixed with the resin and running an item to be coated (such as a conductor) through the bath prior to curing the resin.

While micro-particles 5 are illustrated in FIGS. 1A and 1B as having a generally spherical shape, it should be appreciated that micro-particles may be formed to any desired shape or be of an arbitrary shape. For example, micro-particles may be shards of arbitrary or amorphous shape resulting from breaking, grinding, or other rendering a desired material into particulate matter. Moreover, micro-particles may be formed having micro-volumes or small cavities that are void, porous or contain air and/or other substances. For example, micro-particles 5 may include flame and/or smoke retardant materials such as carbon dioxide.

Micro-particles are not limited to non-burnable or non-smokeable material. For example, micro-particles may be formed from a flame and smoke retardant material such as any of various fluoropolymer compounds. Such fluoropolymer micro-particles may be embedded in, or mixed with, a less expensive material to achieve a reduced cost insulating layer having desirable burn characteristics.

In general, micro-particles may be provided in a number of ways to both improve the insulating layers resistance to flame and smoke and to facilitate forming a cable that can satisfy the various burn tests utilized by the UL in order to achieve a plenum rating. For example, non-burnable and/or non-smokeable micro-particles may reduce the amount of smoke producing material in a cable, improving the cables performance in peak and average smoke tests. Similarly, less expensive micro-particles having superior burn and smoke characteristics may reduce the amount of or eliminate altogether costly fluoropolymers conventionally used to provide a plenum rated cable. For example, the micro-particles may be used in connection with relatively inexpensive thermoplastic such as polyolefin to achieve satisfactory burn characteristics without having to resort to expensive fluoropolymer materials.

Certain electrical properties of a twisted pair may depend on the materials used in construction. For example, the characteristic impedance of a twisted pair is related to several parameters including the diameter of the conductors 10*a*, 10*b*, the center-to-center distance between the conductors, the dielectric constant of insulating layers 12*a*, 12*b*, etc. The center-to-center distance is proportional to the thickness of the insulating layers and the dielectric constant depends in part on the properties of the material. The micro-particles used in constructing the insulating layers may be chosen such that insulating layers achieve a desired effective dielectric constant. For instance, hollow or air-filled micro-particles may be embedded in a dielectric material forming the insulating layer, thereby lowering the effective dielectric constant of the insulating layer. The number of such micro-particles embedded in the insulating layer may be controlled so as to control the effective dielectric constant of the resulting composite (dielectric plus micro-particles) insulating layer material.

Accordingly, the dielectric constant may be reduced and/or tailored to meet the requirements of a particular design. Reduced dielectric constants for insulated conductors may yield higher transmission propagation speeds and have generally desirable skew characteristics. In general, it is to be appreciated that micro-particles may be used to tailor any characteristic of the cable, such as, but not limited to, characteristic impedance, burn characteristics, skew, crosstalk, etc.

It should be appreciated that various aspects of the present invention may be applied to other components of a data communication cable including, but not limited to, separators, binders, jackets, and the like. For example, many high performance cables employ some form of separator between the individual twisted pairs in a cable to further reduce crosstalk. Examples of such separators include, but are not limited to, cross-web separators and various configurable core separators that facilitate simple provision of any number of desirable arrangements available for separating twisted pairs or certain desired pairs in a multi-pair cable.

Figure 2:
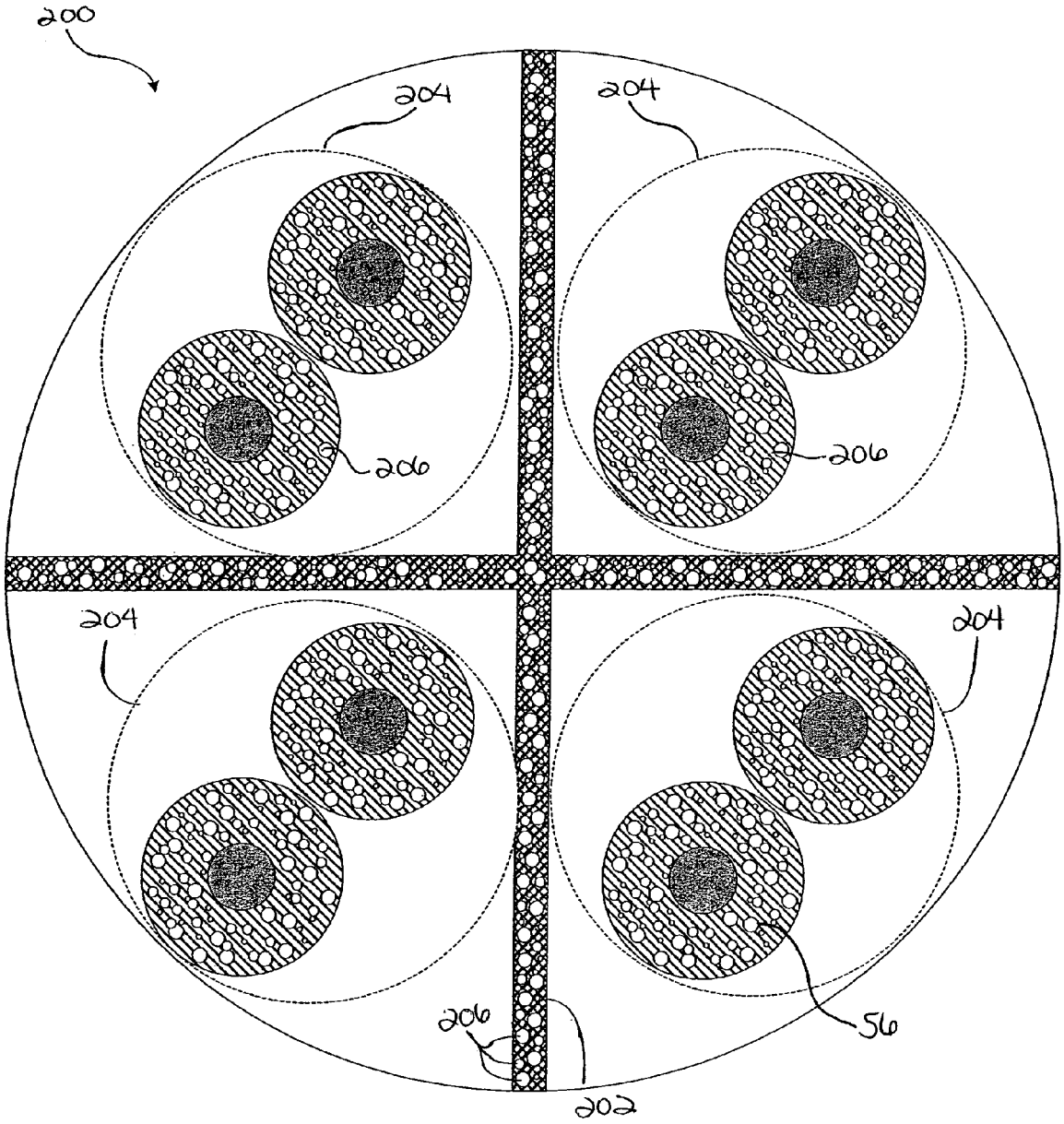
FIG. 2 is a cross-sectional view of another embodiment of a cable according to aspects of the invention.

Referring to FIG. 2, there is illustrated another embodiment of a twisted pair cable 200 including a separator 202 that is disposed between the twisted pairs 204. In the illustrated example, each of the twisted pairs is separated from adjacent pairs by a flange of a cross or "+" shaped separator 202. However, it is to be appreciated that the separator 202 may have any of a variety of shapes and is not limited to a "+" shaped structure. In conventional plenum cables, separators are often made from relatively expensive fluoropolymer materials. In one embodiment, separator 202 may be made of any of various materials used in manufacturing separators, for example, a thermoplastic material. As shown, a plurality of micro-particles 206 are included in the material forming separator 202. As discussed above in connection with FIG. 1, the micro-particles may be of any shape and may comprise various flame and smoke resistant materials including glass, ceramic, fluoropolymers, etc. The micro-particles may comprise open or closed volumes and may contain other agents, for example, like flame retardant substances such as carbon dioxide.

According to one embodiment, illustrated in FIG. 2, the insulating layers 56 of the twisted pairs 204 may contain micro-particles 206. However, it should be appreciated that one, a plurality, or all of the twisted pairs 204 may be formed without micro-particles being in the insulating layers 56. Moreover, any of the various arrangements and compositions of micro-particles and materials described in connection with the insulators of FIG. 1 may be applied to any of various separators (e.g., separator 202) either individually or in combination with the insulators.

Thus, according to aspects of various embodiments, cables may be formed according to the invention using micro-particles 206 in all or any of the insulating layers 56 of the twisted pairs 204 and also optionally in the separator 202, in any combination. For example, the embodiment illustrated in FIG. 2 includes micro-particles in all of the insulating layers 56 and the separator 202. However, in another embodiment, for example, only one or two of the twisted pairs may have insulating layers including micro-particles and a separator may or may not include micro-particles.

Figure 3:
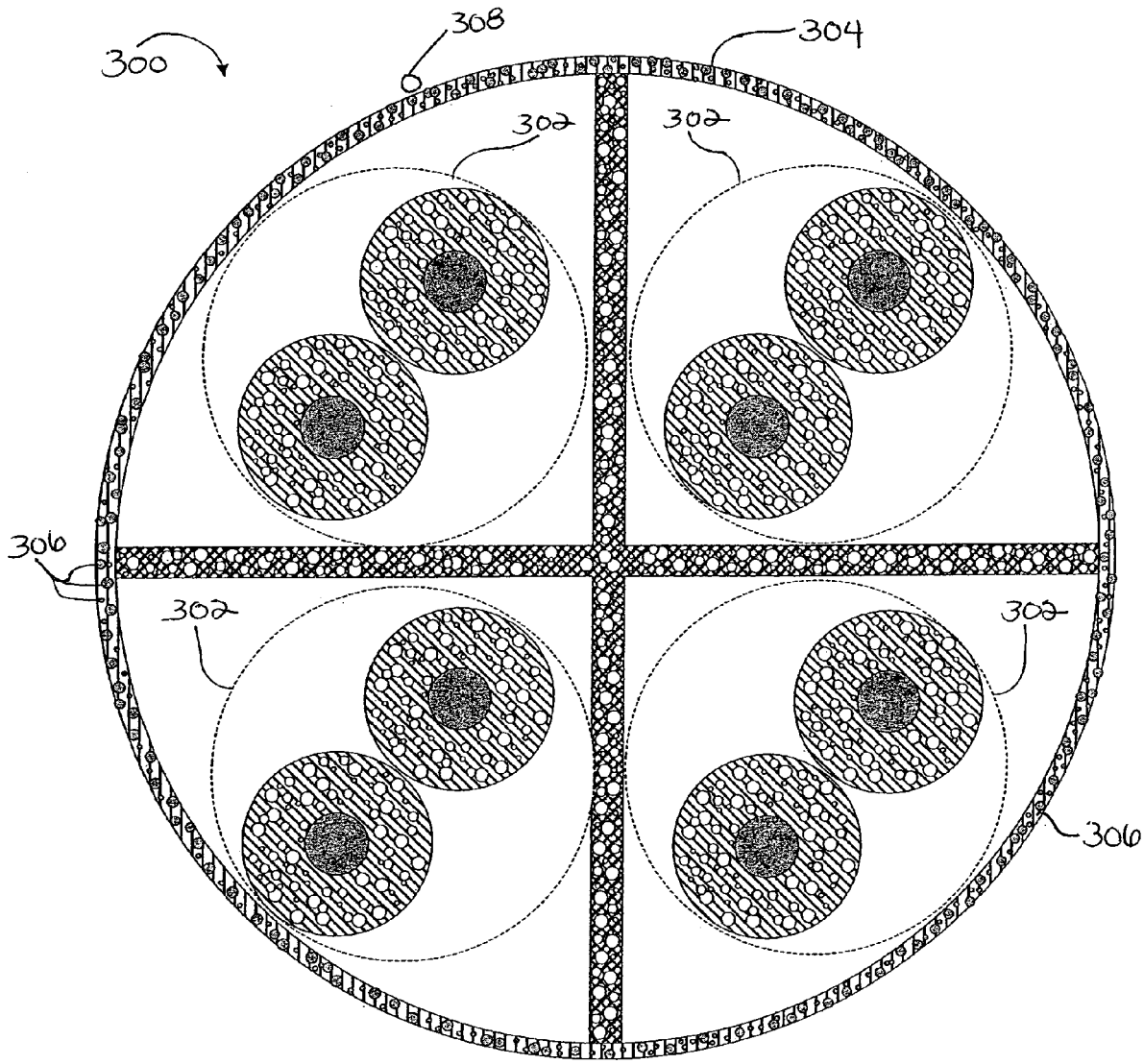
FIG. 3 is a cross-sectional view of another embodiment of a cable according to aspects of the invention.

Referring to FIG. 3, there is illustrated another embodiment of a cable 300 according to aspects of the invention. The cable 300 includes a plurality of twisted pairs 302 that may be separated by a separator 202 and are held in place and proximate each other and the separator 202 by a jacket 304. Conventional plenum-rated cables often include jackets made from a flame and smoke retardant PVC material. According to one embodiment of the present invention, as illustrated in FIG. 3, the jacket 304 may be made to include a plurality of micro-particles 306 as part of, or embedded in or mixed with, the material forming the jacket 304. As discussed above, although the micro-particles 306 are illustrated as being generally spherical, they may be of any shape or structure including solid, hollow, porous, filled with another substance to reduce flame and/or smoke and may otherwise be arranged, composed and provided according to any of the various alternatives and methods described in the foregoing.

In addition, it is to be appreciated that in any embodiment, the micro-particles used in the jacket, the separator and the insulating layers may be the same or different shape, size and structure. For example, in one embodiment, all the micro-particles used in each of the jacket, separator and insulating layers may be solid glass or ceramic spheres or shards. In another embodiment, any or all of the insulating layers of the twisted pairs may include air-filled micro-particles while the separator may include solid glass micro-particles. It is to be appreciated that there are many possible variations of the type, number, shape etc., of micro-particles used in any of the insulating layers, the jacket and the separator. All of these possible variations are intended to be part of this invention and covered by this disclosure.

Referring again to FIG. 3, according to another aspect of the invention, the micro-particles 306 may be filled with a chemical or substance adapted to indicate at least one characteristic of the environment of the cable. For example, some of micro-particles 306 may include a chemical having a property (e.g., color) that changes as a function of ambient thermal conditions. Many PVC jackets are vulnerable to cracking when handled at low temperatures. Accordingly, a color change of the micro-particles may alert a cable installer that the temperature is too low to safely pull the cable and that the integrity of the cable may be at risk should it be twisted, bent, cornered or otherwise handled roughly.

According to another embodiment, some of micro-particles 306 may include substances that have a property (e.g., color) that changes as a function of the frequency of proximate electromagnetic radiation. Accordingly, the micro-particles may respond to the frequency of the data transmission of the cable as indication of the performance of the particular cable, or in response to radiation in the environment. In yet another embodiment, some of the micro-particles 306 may be filled with one type of chemical, for example that is able to indicate environmental conditions of the cable while others of the micro-particles 306 may be filled with substances that are adapted to indicate characteristics (such as frequency of data transmission) of the cable itself. Accordingly, so-called "smart-cables" can be adapted to be responsive both to internal and external operating characteristics of the environment.

Applicant has further appreciated that various testing, diagnostic and informational benefits may be derived by employing one or more light pipes within a cable. A light pipe refers generally to any light transmissive medium that facilitates the propagation of optical energy. For example, light pipes may be constructed from lucite, acrylic, optical fiber, etc.

According to one aspect of the invention, one or more light pipes 308 are embedded into the jacket of a cable. Preferably, the light pipe 308 would run or span the length of the cable such that light signals may be propagated, for example, from the source end of a cable to its termination. A light pipe may be produced as a cylindrical structure or may be provided as a generally planar material conformable to a surface of a cable such as, for example, the cable jacket. A light pipe may be employed in a cable as a device used to aid in identifying the cable. For example, in a structured cable system, the light pipe 308 could be illuminated at its port in a network computer room or at its connection in a telecommunications closet so that it can be quickly and easily determined which cables are ultimately connected at which ports.

In addition, network failures or faulty connections may be easily identified and rectified by illuminating the problem node via its cable connection. Various other diagnostic and identification tasks may be achieved by the provision of a light pipe, such as tracing and general troubleshooting. Furthermore, the light pipe may be adapted to transmit information, for example, as a serial communications such that more sophisticated information may be relayed via the light pipe.

Having thus described several aspects of at least one embodiment of this invention, it is to be appreciated various alterations, modifications, and improvements will readily occur to those skilled in the art. Such alterations, modifications, and improvements are intended to be part of this disclosure, and are intended to be within the scope of the invention. Accordingly, the foregoing description and drawings are by way of example only.

What is claimed is:

1. A data communication cable comprising:

a plurality of twisted pairs of insulated conductors, each twisted pair comprising two electrical conductors, each surrounded by an insulating layer and twisted together to form the twisted pair; and a jacket substantially enclosing the plurality of twisted pairs of insulated conductors;

wherein the insulating layer comprises a dielectric material comprising a first plurality of micro-particles embedded in the dielectric material; and wherein the micro-particles consist of solid glass particles.

2. The data communication cable as claimed in claim 1, wherein the jacket comprises a dielectric material comprising a second plurality of micro-particles.

3. The data communication cable as claimed in claim 2, wherein the second plurality of micro-particles are substantially spherical in shape.

4. The data communication cable as claimed in claim 1, further comprising a separator disposed among the plurality of twisted pairs of insulated conductors.

5. The data communication cable as claimed in claim 4, wherein the separator comprises a material having a second plurality of micro-particles disposed therein.

6. The data communication cable as claimed in claim 1, wherein the number of the first plurality of micro-particles within the insulating layer is controlled so as to provide a desired effective dielectric constant of the insulating layer.

7. The data communication cable as claimed in claim 1, further comprising a light pipe disposed proximate a surface of the jacket.

8. The data communication cable as claimed in claim 7, wherein the light pipe comprises a material that is conformable to the surface of the jacket.

9. The data communication cable as claimed in claim 7, wherein the light pipe has a predetermined color that serves to identify a characteristic of the data communication cable.

10. The data communication cable as claimed in claim 1, wherein the insulating layer comprises a thermoplastic material.

11. The data communication cable as claimed in claim 1, wherein the insulating layer is constructed with an appropriate combination of micro-particles and dielectric material such that the insulation layer is suitable for use as a single-layer insulation.

12. The data communication cable as claimed in claim 1, wherein the micro-particles are substantially spherical in shape and have a diameter of between approximately 50 micrometers and 300 micrometers.

13. A data communication cable comprising:

a plurality of twisted pairs of insulated conductors, each twisted pair comprising two electrical conductors, each surrounded by an insulating layer and twisted together to form the twisted pair;

a jacket substantially enclosing the plurality of twisted pairs of insulated conductors; and a separator disposed among the plurality of twisted pairs of insulated conductors so as to separate at least one twisted pair of insulated conductors from others of the plurality of twisted pairs of insulated conductors;

wherein the jacket includes a dielectric material comprising a first plurality of micro-particles, the first plurality of micro-particles being substantially spherical in shape and having a diameter of between approximately 50 micrometers and 300 micrometers; and wherein the separator includes a dielectric material having solid glass micro-particles embedded therein.

14. The data communication cable as claimed in claim 13, wherein the micro-particles comprise a non-burnable material.

15. The data communication cable as claimed in claim 13, wherein the micro-particles comprise a non-smokeable material.

16. The data communication cable as claimed in claim 13, wherein the first plurality of micro-particles are glass.

17. The data communication cable as claimed in claim 13, wherein the first plurality of micro-particles are filled with a substance having at least one property that changes as a function of thermal conditions of the cable.

18. The data communication cable as claimed in claim 13, wherein the insulating layer comprises a second plurality of micro-particles arranged within the insulating layer.

19. The data communication cable as claimed in claim 13, wherein first plurality of micro-particles include at least one of diamond dust, a ceramic material, solid glass particles, and a porous material.

20. The data communication cable as claimed in claim 13, wherein the first plurality of micro-particles comprise fluoropolymer micro-particles.

21. The data communication cable as claimed in claim 13, wherein the solid glass micro-particles are substantially spherical in shape and have a diameter in a range of about 50 micrometers to about 300 micrometers.

* * * * *

UNITED STATES PATENT AND TRADEMARK OFFICE

CERTIFICATE OF CORRECTION

PATENT NO. : 7,244,893 B2
APPLICATION NO. : 10/862767
DATED : July 17, 2007
INVENTOR(S) : William T. Clark It is certified that error appears in the above-identified patent and that said Letters Patent is hereby corrected as shown below:

In column 2, line 63, “1A.” should read --1A;--.

In column 5, line 19, “andlor” should read --and/or--.

Signed and Sealed this

Second Day of October, 2007

JON W. DUDAS
*Director of the United States Patent and Trademark Office*